United States Patent [19]

Carlsson

[11] Patent Number: 4,805,703

[45] Date of Patent: Feb. 21, 1989

[54] METHOD AND APPARATUS FOR SEPARATING FINE AND COARSE MATERIALS FROM EXCAVATED MATERIALS

[75] Inventor: Leif E. C. Carlsson, Eslöv, Sweden

[73] Assignee: Prodec Inter AB, Eslöv, Sweden

[21] Appl. No.: 788,639

[22] Filed: Oct. 17, 1985

[30] Foreign Application Priority Data

Oct. 18, 1984 [SE] Sweden ..... 8405199

[51] Int. Cl.[4] ..... E02F 7/00; E02F 3/40

[52] U.S. Cl. ..... 171/132; 37/118 A; 209/420; 209/288; 209/664

[58] Field of Search ..... 171/132, 135, 129, 128, 171/1; 209/664, 288, 235, 420, 421, 241, 683; 37/118 R, 4, 118 A, ; 414/705; 366/606

[56] References Cited

U.S. PATENT DOCUMENTS

| | | | |
|---|---|---|---|
| 683,775 | 10/1901 | Kirkpatrick | 299/7 |
| 928,965 | 7/1909 | Hanna | 366/234 |
| 1,793,389 | 2/1931 | Elmer | 209/420 |
| 2,119,676 | 6/1938 | Heller | 209/288 |
| 2,422,985 | 6/1947 | Reckler | 171/135 X |
| 2,882,976 | 4/1959 | Wheeler et al. | 171/128 |
| 3,003,265 | 10/1961 | Lutjens | 209/421 X |
| 3,033,394 | 5/1962 | Kashergen | 172/247 |
| 3,072,257 | 1/1963 | Hockenberry | 171/132 |
| 3,231,246 | 1/1966 | Deen | 366/606 |
| 3,431,662 | 3/1969 | Bles | 37/118 R |
| 3,461,968 | 8/1969 | Longley | 171/132 |
| 3,765,490 | 10/1973 | Logue | 171/132 |
| 4,005,755 | 2/1977 | Bakke et al. . | |
| 4,018,675 | 4/1977 | Petrucci | 209/664 X |
| 4,157,956 | 6/1979 | Robinson . | |

FOREIGN PATENT DOCUMENTS

| | | | |
|---|---|---|---|
| 0047041 | 3/1982 | European Pat. Off. . | |
| 3101606 | 9/1982 | Fed. Rep. of Germany | 171/132 |
| 3403818 | 8/1984 | Fed. Rep. of Germany | 209/288 |
| 8201022 | 4/1982 | PCT Int'l Appl. | 171/44 |
| 1291555 | 10/1972 | United Kingdom | 171/132 |
| 1512206 | 5/1978 | United Kingdom . | |

OTHER PUBLICATIONS

Rock Products, "New Machinery and Equipment", p. 96 (undated).

*Primary Examiner*—Richard J. Johnson

*Attorney, Agent, or Firm*—Foley & Lardner, Schwartz, Jeffery, Schwaab, Mack, Blumenthal & Evans

[57] ABSTRACT

This inventions's method separates from excavated materials (2) fine constituents (3), preferably topsoil, and coarse constituents (4), preferably stones, roots or root crops. The materials to be excavated (2) are excavated by an excavating and separating bucket (11), of grid structure, which is subjected to separating movements causing the fine constituents (3) to escape from the excavating and separating bucket (11) through apertures provided for that purpose. To produce shock-free separating movements the excavating and separating bucket (11) is rotated continuously through one or preferably a plurality of revolutions in the same direction of rotation (R).

A simple apparatus for carrying the method of the invention into effect is described. The excavating and separating bucket (11) is a unit (5) connected to an excavating and elevating assembly (8) on a vehicle (9). A rotation assembly (10) to rotate the excavating and separating bucket (11) continuously through one or preferably more revolutions in the same direction of rotation (R) to produce shock-free separating movements. The excavating and separating bucket (11) has one or more, preferably four, pockets which are adapted to elevate the excavated materials (2) contained in the excavating and separating bucket (11) at every revolution and let them down again into the lowermost portions of the excavating and separating bucket (11).

22 Claims, 5 Drawing Sheets

METHOD AND APPARATUS FOR SEPARATING FINE AND COARSE MATERIALS FROM EXCAVATED MATERIALS

TECHNICAL FIELD

This invention relates to a method of separating from excavated materials, fine constituents, preferably topsoil, and coarse constituents, preferably stones, roots or root crops. The materials are excavated by an excavating and separating bucket of grid structure. Separating movements cause the fine constituents to escape through apertures provided for that purpose. The invention also concerns an apparatus for carrying out the method of the invention.

BACKGROUND OF THE INVENTION

U.S. patent application Ser. No. 683,775 describes a dipper for receiving and screening fine and coarse constituents of collected rock. The dipper has openings in its sides and is mounted on an excavator so as to be elevated. Screening takes place in that the fine constituents drop out of the openings.

U.S. Pat. No. 3,072,257 and UK Pat. No. 1,291,555 describe screening buckets subjected to reciprocating rocking and tilting movements for an increased screening effect. U.S. Pat. No. 3,461,968 describes a screening scoop which is vibrated for an increased screening effect.

The problem of subjecting screening or separating buckets to reciprocating shaking or vibrating movements is that these movements are transmitted to the frame and/or the vehicle on which the bucket is mounted. As a result, violent shaking movements and/or vibrations are transmitted to the equipment and/or personnel. Such vibrations and shaking movements create very great risk of material fatigue and/or bodily injury. The risk increases as the shaking movements increase for further improvement of the separating effect. Intense shaking movements and/or vibrations also generate inconvenient noise.

International Patent Application WO No. 82/01022 teaches a pivotal movement of buckets for setting a bucket into various positions relative to an initial position. The pivotal movement setting the bucket into various angular positions is intended to permit the bucket to be set for excavating both horizontal and inclined areas. It does not provide any solution to the problems of eliminating troublesome shaking movements, vibrations and noise in separating work.

SUMMARY OF THE INVENTION

The primary object of the present invention is to provide a method for effective separation of the excavated materials by an excavating and separating means that does not generate troublesome shaking movements, vibrations and noise. This is realized by the invention through an excavating and separating bucket of grid structure that is rotated continuously through one or, preferably, a plurality of revolutions in the same direction of rotation, to produce shock-free separating movements.

Continuously rotating the excavating and separating bucket (which is designed for effective excavation of the materials) together with the materials collected in the bucket, through one or more revolutions in the same direction of rotation, generates only gentle movements instead of violent shaking movements or vibrations, which have an injurious effect on equipment or personnel after a short time of operation. In addition, inconvenient noise is not produced. Separation takes place substantially without shocks and with only essential noise.

An apparatus suitable for carrying the method of the invention into effect is also presented.

Figure 1:
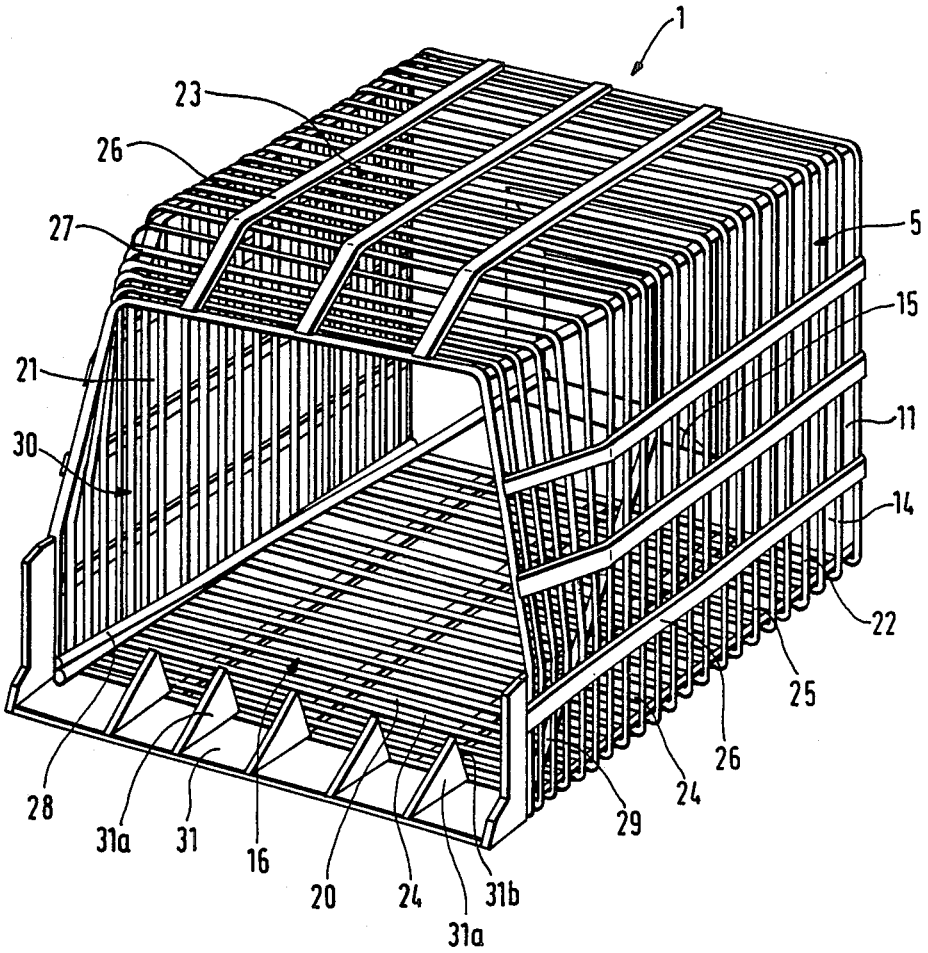
FIG. 1 is a perspective view illustrating an excavating and separating bucket for use in the method of invention.
Figure 2:
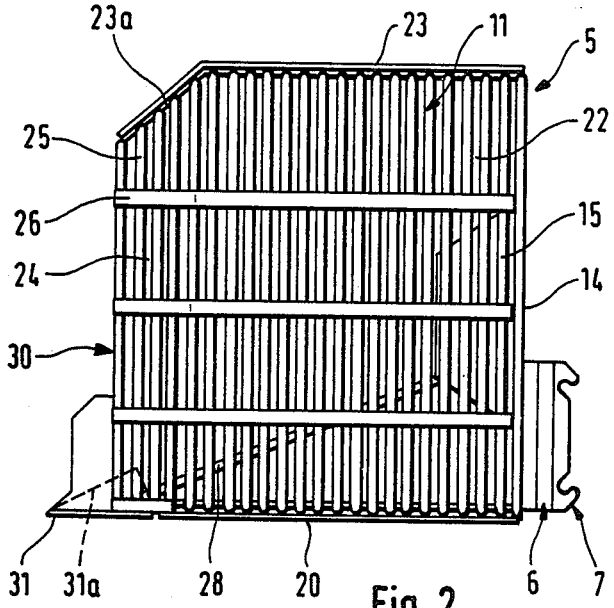
FIG. 2 is a side view of the excavating and separating bucket.

The separating apparatus 1 shown in the drawings is primarily intended for excavating and separating from collected masses of earth 2 fine constituents 3, such as topsoil, and coarse constituents 4, such as roots, twigs 4*a*, stones and the like. The separating apparatus 1 comprises a separate unit 5, which has a frame 6 with connecting means 7 for connecting the unit 5 with an excavating and/or elevating assembly 8 of a vehicle 9, such as a tractor, shovel, wheeled loader or excavating machine. The connecting means 7 are so designed that the excavating and/or elevating assembly 8 of the vehicle 9 can be brought into engagement with said connecting means when the unit 5 stands on the ground. When the connecting means 7 and the excavating and/or elevating assembly 8 are connected they can be interlocked by means of latches (not shown). The frame 6 comprises a rotation assembly 10 which is adapted to rotate a grid structured excavating and separating bucket 11 continuously through one or a plurality of revolutions in one and the same direction of rotation, R, to produce shock-free separation movements.

Figure 4:
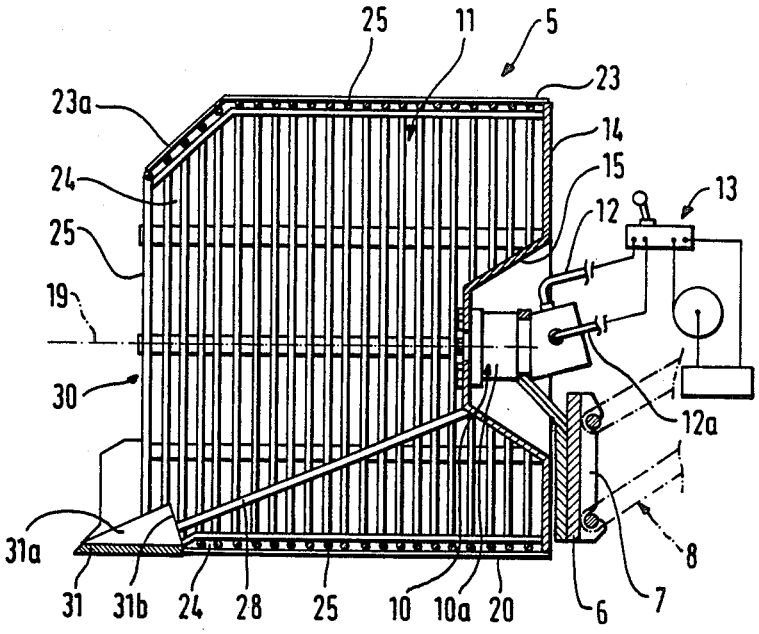
FIG. 4 is a section taken on line IV—IV in FIG. 3.

In the embodiment of FIG. 4, the rotation assembly 10 is a hydraulic assembly 10*a* of the type customarily used to drive the drive wheels of forestry machinery. The hydraulic assembly 10a can be connected via conduits 12 and 12*a* to a hydraulic system 13 inherent in the vehicle so as to be driven with the aid of said system. In the embodiment of FIG. 4, the rear end wall 14 of the excavating and separating bucket 11 is retracted into the excavating and separating bucket. The retracted portion constitutes a shield 15 to which the hydraulic assembly 10*a* is bolted and which screens off said hydraulic assembly 10*a* from the interior 16 of the excavating and separating bucket 11. Said retraction of the hydraulic assembly 10*a* within the excavating and separating bucket 11 implies that the total length of the unit 5 will be smaller than the combined lengths of the excavating and separating bucket 11 and the hydraulic assembly 10*a*.

Figure 5:
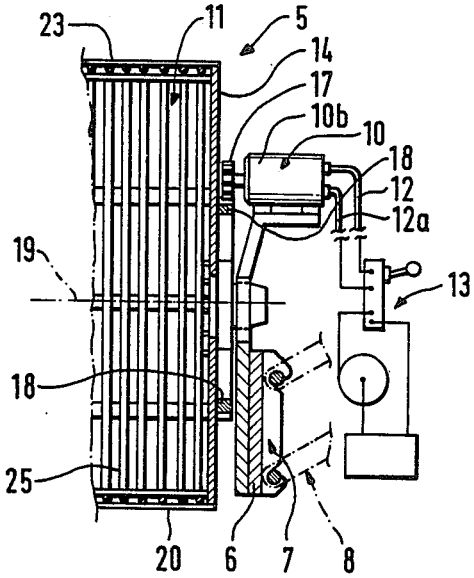
FIG. 5 illustrates the rear part of an excavating and separating bucket of alternative design.

In the embodiment of FIG. 5, the rotation assembly 10 is a hydraulic assembly 10*b* which is connected to the hydraulic system 13 of the vehicle 9 in the same way as the hydraulic assembly 10*a* in FIG. 4. In this case, the hydraulic assembly 10*b* carries on its output drive shaft a gear 17 which is in driving engagement with a gear rim 18 bolted to the rear end wall 14 of the excavating and separating bucket 11. Said end wall may, in this instance, be planar since the gear rim 18 can bear directly against the outer face of the end wall 14, and since the gear rim 18 per se need not be of a large width. Moreover, the hydraulic assembly 10*b* can be spaced a rather great distance from the connecting means 7.

Figure 3:
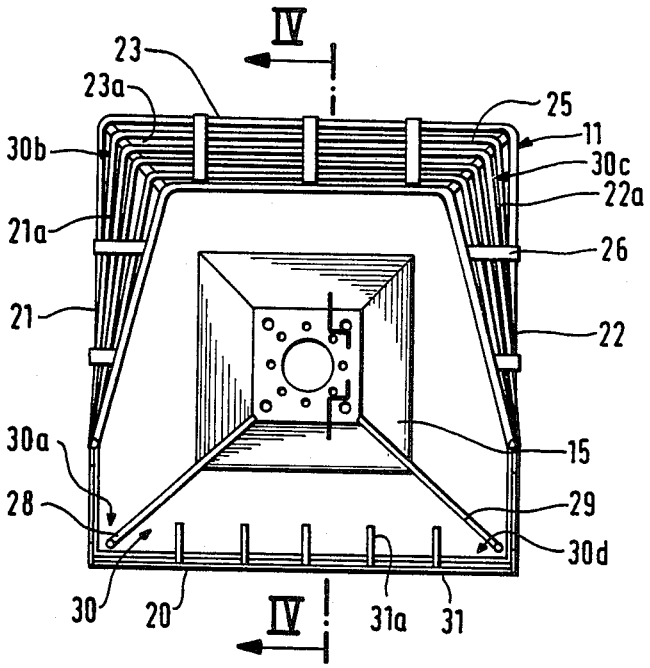
FIG. 3 is a front view of the excavating and separating bucket.

The rotation assembly 10 is adapted to rotate the excavating and separating bucket 11 about the axis of rotation 19. To ensure the requisite uniform rotation, it is advantageous to locate the excavating and separating bucket 11 at least tolerably centered in relation to said axis of rotation 19. The excavating and separating bucket 11 has four forwardly extending sides 20, 21, 22 and 23, with apertures 24 therein for fine constituents 3, i.e., in the present case, for topsoil. The sides 20–21 in this case consist of rods 25 extending around the circumference interconnected by means of forwardly directed stays 26, so that the rods 25 and the stays 26 together form a grid structure 27. For rigidity, two or more stays 28, 29 may be arranged within the excavating and separating bucket 11 between the shield 15 and the sides 20–23 of the excavating and separating bucket 11 in front of the shield 15, (See FIG. 3).

In the interior 16 of the excavating and separating bucket 11, the sides 20–21 together form a corner 30*a*, the sides 21 and 23 together form a corner 30*b*, the sides 23 and 22 together form corner 30*c* and the sides 22 and 20 together form a corner 30*d*. Said corners 30*a*–30*d* are adapted, during the rotation of the excavating and separating bucket 11, to form four pockets for the masses of earth 2 in the interior 16 of the excavating and separating bucket 11. Each such pocket 30*a*–30*d* carries along a large part of the bucket's initial mass of earth 2 in an upward direction until the respective pocket 30*a*–30*d* approaches or reaches its uppermost position. Another part of the initial mass of earth 2 in said pocket is not carried along, but slides down along one of the sides 20–23. When the respective pocket 30*a*–30*d* approaches or reaches the uppermost position, the upwardly moved portion of the mass of earth 2 cannot retain its hold in the pocket, but falls freely downward in the excavating and separating bucket 11. This mass of earth lands on the portion of the masses of earth 2 at the bottom of the excavating and separating bucket 11.

By causing portions of the masses of earth 2 to fall down in the excavating and separating bucket 11 in the manner indicated, the clods of earth falling down and/or lying at the bottom of the excavating and separating bucket 11 are comminuted or pulverized. The stones falling down together with the upwardly moved portion of the masses of earth 2 highly contribute to said comminution as they hit earth clods during or at the end of their fall.

Since the excavating and separating bucket 11 in the embodiment illustrated has four sides 20–23, which form four corners and thus four pockets 30*a*–30*d*, portions of the mass of earth will be raised and fall down four times for every revolution.

The excavating and separating bucket 11 illustrated may be provided with further pockets (not shown) arranged in or on one or more of the sides 20–23, and pockets may be formed by outwardly curving side portions (not shown), inwardly curving side portions or vane-like drivers (not shown) mounted on the sides and protruding inwardly.

With a trilateral excavating and separating bucket 11 instead of a quadrilateral one, the sides instead form three corners which can be utilized as pockets to carry along masses of earth in an upward direction. A trilateral embodiment of the excavating and separating bucket 11 also may have more than three pockets for carrying along masses of earth. In the same way an excavating and separating bucket design having five sides may present five or more pockets for carrying along masses of earth, a hexahedral excavating and separating bucket design may present six or more pockets for carrying along masses of earth, etc.

The excavating and separating bucket 11 has a front opening 30 for receiving the mass of earth 2 and for discharging such coarse constituents 4 as will remain in the excavating and separating bucket 11 after fine constituents 3 have been screened through the apertures 24 in the sides 20–23. To facilitate reception of masses of earth 2 in the excavating and separating bucket 11, the side 20 at the front opening 30 has a forwardly directed excavating or cutting blade 31.

To reduce or prevent portions of the masses of earth 2 from falling out of the opening 30 of the excavating and separating bucket 11 when said bucket 11 is rotated to cause the fine constituents 3 to fall out of the apertures 24 in the sides 20–23 of the excavating and separating bucket 11, the sides 21, 22 and 23 at the front have retracted portions 21*a*, 22*a* and 23*a*. The side 20 having the excavating blade 31 is not retracted or is only slightly retracted. In order that this side 20 also shall effectively prevent portions of the masses of earth 2 from falling out, the excavating blade 31 has a number of upstanding flange means 31*a* which extend rearwardly a distance into the excavating and separating bucket 11. Said flange means 31*a* extend in parallel with the excavating direction in order not to obstruct the masses of earth 2 during the excavating operation. The flange means 31*a* are of such a height and inclination inside 31*b* as not to prevent roots, twigs, large stones and other large constituents 4 in the mass of earth 2 from escaping by catching them at the rotation of the separating means.

The rear end wall 14 may be formed as a shield so that masses of earth cannot fall down onto the rotation assembly 10 and/or other parts located at the rear of the excavating and separating bucket 11. Alternately, the end wall 14 may present apertures for fine constituents 3, especially if it does not matter whether earth falls down on parts of the unit 5 and/or the excavating and/or elevating assembly 8 located at the rear of the excavating and separating bucket 11.

Figure 6:
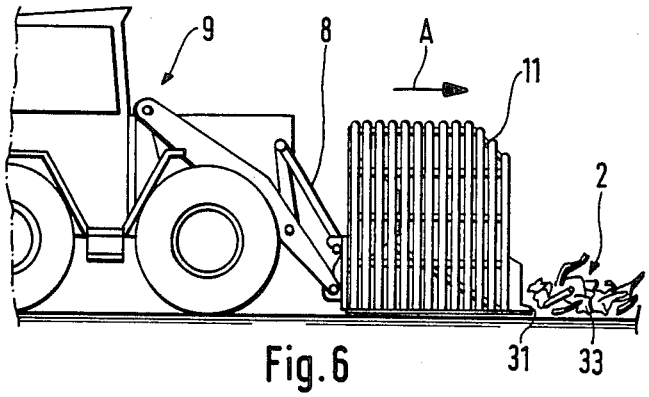
FIGS. 6 to 11 illustrate various phases of the method of invention.
Figure 7:
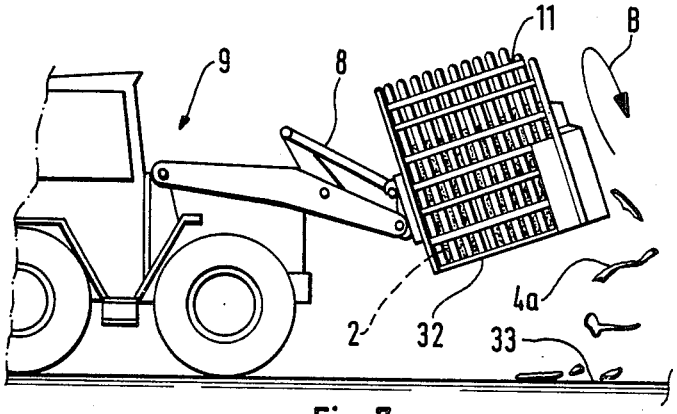
Figure 8:
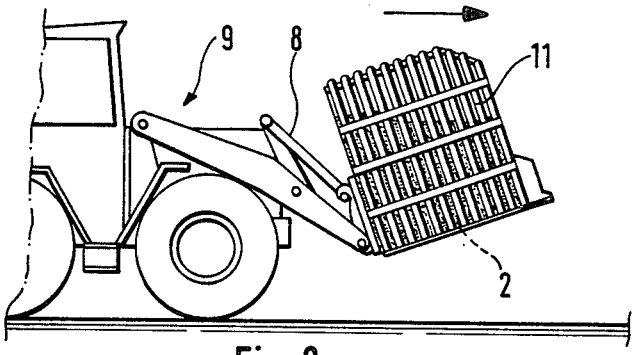

For the separation of masses of earth, the vehicle carrying the bucket is driven up to the unsorted masses of earth 2. If the excavating blade 31 is not at the very bottom in a horizontal excavating position S, the excavating and separating bucket 11 is rotated until the excavating blade 31 occupies said excavating position (cf. FIG. 6). If it is desired to set the excavating blade 31 into a position oblique to the horizontal, the bucket 11 is rotated until the excavating blade 31 reaches such a position, whereupon the bucket 11 is locked against rotation. Then the excavating and separating bucket 11 is moved into the masses of earth 2 (arrow A), the excavating blade 31 facilitating the penetration. When the lower parts of the excavating and separating bucket 11 have been filled with a suitable amount of mass of earth 2, the excavating and separating bucket 11 is raised to a position of rotation (cf. FIG. 7). If coarse constituents 4 in the form of roots or twigs 4*a* hang out of the front opening 30, the excavating and separating bucket 11 may be rotated (arrow B) through one or two revolutions so that the roots or twigs 4*a* drop back onto the spot of collection 33. This will prevent roots and twigs 4*a* from falling down at another spot.

The vehicle 9 is now driven to a location 34 where the fine constituents 3, i.e., in this instance topsoil, are to be deposited. In the present case, this location is a large lot which is to be covered with a rather thin layer of topsoil to permit the sowing of grass. When the excavating and separating bucket 11 has been placed in the correct position at the location 34 (FIG. 9) the bucket is rotated in its position of rotation continuously through the number of revolutions in the same direction of rotation (arrow R) that is required for all fine constituents 3, i.e. all topsoil, to escape from the excavating and separating bucket 11.

The separating movement being a continuous movement of rotation which takes place in the same direction of rotation, there is an effective and entirely shock-free separation whereby neither equipment nor personnel is subjected to intense shocks, shaking movements, vibrations and noise. By continuous movement of rotation in the same direction R through a plurality of revolutions, the improvement over prior art is more precisely understood. The excavating and separating bucket 11 is rotated without interruptions and/or without reciprocatory movements through one or more revolutions because such changes in the movement of rotation would necessitate sudden stops of the excavating and separating bucket with its contents.

At the rotation of the excavating and separating bucket 11, the masses of earth 2 contained in the pockets 30*a*–30*d* of the bucket 11 are caused to follow said pockets in an upward direction and again drop down into the lower parts of the excavating and separating bucket 11. This is repeated four times per revolution, whereby an effective comminution of comminutable constituents of the masses of earth 2 is obtained. During the rotation of the fine constituents 3, they fall out of the bucket little-by-little while the coarse constituents 4 remain and go on partaking in the comminution process. The separation is efficient so that few revolutions (e.g., fifty revolutions) will be required to empty an excavating and separating bucket 11, which is rather well filled with earth 2 of its fine constituents 3. The height of fall in the excavating and separating bucket 11 can be maintained within the limits of an efficient separation such that the drop of the masses of earth does not result in undesirable vibrations.

The speed of rotation is kept within the range of 25–35 r.p.m. About 30 r.p.m. has proven very advantageous for the separation of topsoil from masses of earth 2 collected by means of such an excavating and separating bucket 11 which is of a design and of a suitably large size to permit efficient excavation. The speed of rotation may be varied depending on the type of materials and/or amount of materials. In most cases a speed of rotation of 25–40 r.p.m. is sufficient for efficient separation. Even if the speed of rotation is increased to 40 r.p.m. or more, the excavating and separating bucket 11 retains its "gentle run", i.e., no inconvenient shaking movements or noise arise even at such high r.p.m.

During the rotation at location 34 the vehicle 9 may be propelled slowly (arrow C) in order to distribute the fine constituents 3 dropping down, until ever larger surfaces of the location 34 are covered with topsoil 3. The only directly manual work that need than be done (e.g., before grass is sown), is that the surface of the topsoil layer be levelled with the aid of a suitable tool. All heavy operations in connection with separation and transport have been eliminated.

Whenever the excavating and separating bucket 11 contains a large amount of earth 2, rotation in a slightly rearwardly inclining position is preferable. That is, the bucket is rotated about the inclined axis of rotation 19*a*, FIG. 9. In this position those parts 32 of the excavating and separating bucket 11 which are lowermost and extend rearwardly from the opening 30 are inclined rearwardly and downwardly. When a large portion of the fine constituents 3 has dropped out of the excavating and separating bucket 11, material is left only in the rear parts of the bucket 11. Said bucket 11 may then be tilted slightly forward until it occupies a position in which the lowermost part 32 extends substantially horizontally (position 32*a*).

Figure 9:
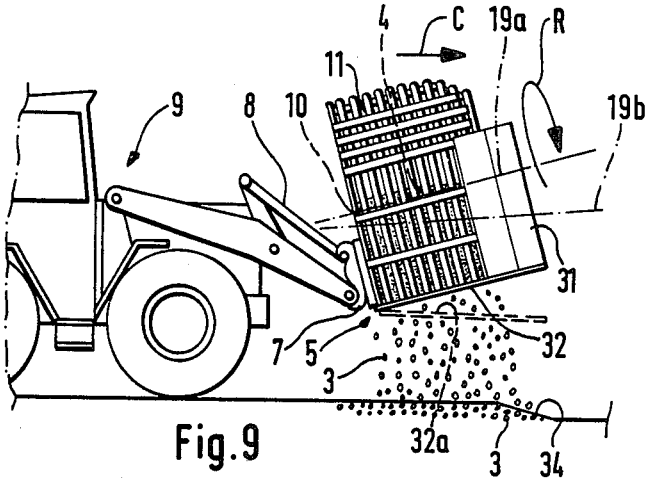

The excavating and separating bucket 11 is rotated in this case about a substantially horizontal axis of rotation 19*b*, FIG. 9. This ensures that the masses of earth 2 are distributed better over the entire length of the excavating and separating bucket 11, i.e., the bucket 11 is exploited to a higher extent and the separation becomes more efficient.

Figure 10:
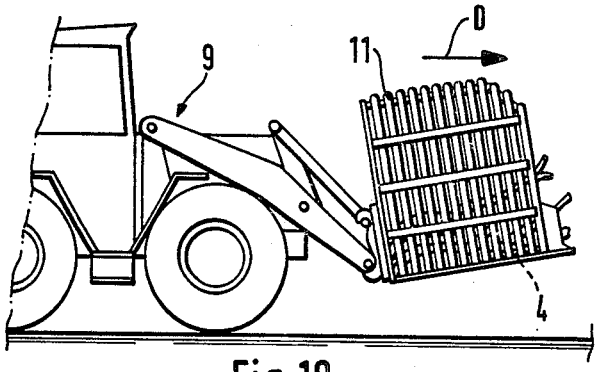
Figure 11:
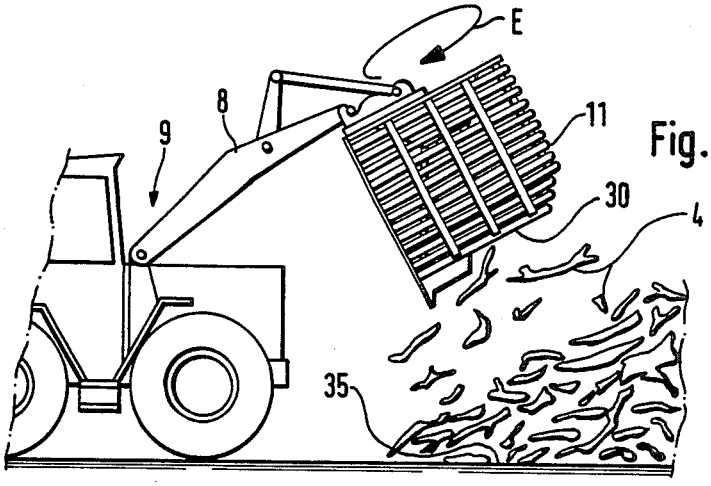

If a smaller amount of earth 2 is excavated at one time by the bucket 11, the bucket 11 can be adjusted into a horizontal position of rotation from the very beginning. Such portions of the masses of earth 2 as reach the front parts of the excavating and separating bucket 11 during the rotation are prevented from dropping out of the opening 30 with the aid of the retracted side portions 21*a*, 22*a*, 23*a* and the flange means 31*a*. When the excavating and separating bucket 11 has been emptied of fine constituents 3 to the requisite extent, the vehicle 9 is driven away (arrow D, FIG. 10) for emptying of the coarse constituents at a location 35 intended for that purpose. At this location 35, the excavating and separating bucket 11 is tipped forward and downward with the aid of the excavating and/or elevating assembly 8. To accelerate emptying of the excavating and separating bucket 11, the bucket 11 may be rotated (arrow E, FIG. 11) when it occupies the tipping position. The vehicle 9 is then driven back to location 33 for collection of fresh masses of earth 2 in the excavating and separating bucket 11, whereupon the above-mentioned separation procedure is repeated.

The entire collection, separation and tipping process can be carried out in one sequence without interruption, and after a short training period, considerable amounts of earth can be separated without subjecting equipment and personnel to troublesome shaking movements or vibrations.

As alternatives to the device described, the rotation assembly may be an assembly of another type, such as an electrically operated motor or diesel-driven engine. The excavating and separating bucket may have any other number of sides than four, and instead of being a grid structure, the bucket may be provided with perforated sides. The sides of the excavating and separating bucket 11 may be retracted along their entire length instead of parts thereof being retracted. The excavating blade may possibly be formed by the very edge of the opening 30, or excavating blades may be formed by, or arranged on, more than one edge. The flange means 31*a* may have a shape other than the one illustrated, their number may vary and they may be provided on more than one side, e.g. on all four sides.

In exceptional cases, it may be sufficient to rotate the excavating and separating bucket 11 continuously through one or possibly somewhat less than one revolution for the requisite separation of fine constituents, but, generally, a plurality of revolutions are required for the separation of most materials.

The excavating and separating bucket 11 may also be placed advantageously above the platform of a truck and rotated in this position. This will permit simultaneous separation and loading of fine constituents.

The separating method and separating apparatus described are particularly suitable for separating topsoil from stones, roots and twigs in masses of earth, but may alternatively be used for separating fine and coarse constituents in other kinds of excavated materials, e.g., stone-containing gravel material. The method and the apparatus may also be used with excavated material in the form of root crops, such as sugar beets with adhering soil, where it is intended to detach the soil from the root crops and to separate the root crops and the detached soil.

I claim:

1. An apparatus for separating from excavated materials fine constituents and coarse constituents, said apparatus comprising:

(a) an excavating and separating bucket with a closed rear side, four sidewalls extending forward from said rear side each of the sidewalls having openings further comprising a grid structure for the fine constituents, at least one of said sidewalls having an excavating blade, and a permanently open front side;

(b) means for connecting said excavating and separating bucket to an excavating and separating assembly of a vehicle; and (c) means mounted on said bucket for continuously rotating through a plurality of revolutions said excavating and separating bucket about an axis of rotation extending through said bucket from said rear side thereof towards said front side, whereby the rotation of said excavating and separating bucket causes the fine constituents to fall out of the bucket through the opening provided in said sidewalls.

2. An apparatus as claimed in claim 1, wherein the excavating and separating bucket is provided with flange means on one of said sides having openings for fines, whereby said flange means extends into said open front side.

3. An apparatus as claimed in claim 1, wherein said rotating means is a hydraulic assembly, said rotating means is connectable to a hydraulic system of the vehicle for the operation thereof, and said hydraulic assembly is disposed within said excavating and separating bucket separated from the constituents in said bucket by means of a shield to which said hydraulic assembly is bolted.

4. An apparatus as claimed in claim 1, wherein said rotating means is a hydraulic assembly which is connectable to a hydraulic system of the vehicle for the rotation thereof, and which via a gear drives a gear rim fixedly connected to said excavating and separating bucket, said gear rim being disposed on the outer face of a rear end wall of said excavating and separating bucket.

5. An apparatus for separating from excavated material fine constituents and coarse constituents, said apparatus comprising:

(a) an excavating and separating bucket with a rear side, wherein said rear side of said excavating and separating bucket is closed, sidewalls extending forward from said rear side and having openings for the fine constituents, at least one of said sidewalls having an excavating blade, and a permanently open front side and wherein at least one of said sidewalls having openings for fine constituents is retracted in at least part of its length as seen in a forward direction toward said open front side to constitute an inner space in the excavating and separating bucket, said space tapering forward toward said front side;

(b) means for connecting said excavating and separating bucket to an excavating and separating assembly of a vehicle; and (c) means mounted on said bucket for continuously rotating said excavating and separating bucket about an axis of rotation extending through said bucket from said rear side thereof towards said front side, whereby the rotation of said excavating and separating bucket causes the fine constituents to fall out of the bucket through the opening provided in said sidewalls.

6. An apparatus as claimed in claim 5, wherein said excavating and separating bucket has four sidewalls with openings for fine constituents.

7. An apparatus as claimed in claim 5, wherein said sides of the excavating and separating bucket having apertures for fine constituents comprises a grid structure.

8. An apparatus as claimed in claim 5, wherein said rotating means rotates said excavating and separating bucket through a plurality of revolutions.

9. A method of separating from excavated materials fine constituents and coarse constituents comprising the steps of:

(a) excavating material with an excavating and separating bucket having a rear side, sidewalls extending from said rear side having openings for the fine constituents and at least one of said sidewalls having an excavating blade, and a permanently open front side;

(b) elevating said bucket by means of an excavating assembly of a vehicle attached to said bucket by a connection means;

(c) rotating said bucket through a plurality of revolutions about an axis extending perpendicularly through said front side by means of a rotation assembly mounted on said bucket, causing the fine constituents to fall out of said bucket through the openings provided in said sidewalls; and (d) tilting said bucket by means of the excavating assembly of the vehicle to discharge the coarse constituents through the open front side.

10. A method as claimed in claim 9, further comprising the step of tilting said bucket by means of the excavating assembly of the vehicle to discharge the coarse constituents through the open front side.

11. A method as claimed in claim 9, wherein said bucket is rotated through a plurality of revolutions.

12. A method of separating fine constituents from coarse constituents in excavated materials, said method comprising the steps of:

(a) excavating materials to be separated into an excavating and separating bucket, said bucket having a grid structure, an excavating blade located at and open front end, and apertures permitting the fine constituents to escape, the excavating bucket being rotated and locked into a position inclined to the horizontal, moved into materials to be excavated, moved to an area for depositing fine constituents, and rotated;

(b) continuously rotating said bucket through at least one revolution in the same direction about an axis extending through the bucket from a rear side toward said front side, for the purpose of producing shock free separating movements;

(c) after separating the fine constituents, tipping the bucket and rotating the bucket while in said tipped position, for the purpose of collecting coarse constituents, which fall out said open front end, at a coarse constituent collection location.

13. The method as recited in claim 12, wherein said bucket is rotated when excavated materials occupy a lowest portion of said bucket, along an axis which is substantially horizontal.

14. The method as recited in claim 12, wherein said bucket is first rotated when excavated materials occupy a lowest portion of said bucket, along an axis which is slightly inclined from a horizontal toward the rear of said bucket, and is subsequently rotated along an axis which is substantially horizontal.

15. The method as recited in claim 12, wherein excavated materials are elevated within said bucket and dropped down to a lowest portion of said bucket at least one time per revolution.

16. The method as recited in claim 12, wherein said bucket is rotated at a speed between about 20 r.p.m. and about 40 r.p.m. for the purpose of causing fine constituents to fall out of said apertures.

17. The method as recited in claim 12, wherein said bucket having an excavating blade located at said open front end, is rotated and locked into a substantially horizontal position, moved into materials to be excavated, moved to an area for depositing fine constituents, and rotated.

18. The method as recited in claim 37, wherein said bucket is rotated above a location where materials are excavated, for the purpose of causing coarse constituents which hang out of said open front end of said bucket to drop back down onto the location of the excavated material.

19. The method as recited in claim 37, wherein, after separating of fine constituents, said bucket is tipped and rotated while in said tipped position, for the purpose of collecting coarse constituents, which fall out said open front end, at a coarse constituent collection location.

20. The method as recited in claim 42, wherein said bucket is rotated above a location where materials are excavated, for the purpose of causing coarse constituents which hang out of said open front end of said bucket to drop back down onto the location of the excavated material.

21. A method of separating fine constituents from coarse constituents in excavated materials, said method comprising the steps of:

(a) excavating materials to be separated into an excavating and separating bucket, said bucket having a grid structure, an open front end, and apertures permitting the fine constituents to escape;

(b) continuously rotating said bucket at a speed between about 20 r.p.m. and about 40 r.p.m. through at least one revolution in the same direction about an axis extending through the bucket from a rear side toward said front side, for the purpose of producing shock free separating movements and causing fine constituents to fall out of said apertures, the rotation occurring when excavated materials occupy a lowest portion of said bucket, along an axis which is substantially horizontal, the rotation further causing the excavated materials to be elevated within said bucket and dropped down to a lowest portion of said bucket at least one time per revolution, wherein said bucket having an excavating blade, located at said open front end, is rotated and locked into a position inclined to the horizontal, moved into materials to be excavated, moved to an area for depositing fine constituents, and rotated.

22. A method of separating fine constituents from coarse constitutents in excavated material, said method comprising the steps of:

(a) excavating materials to be separated into an excavating and separating bucket, said bucket having a grid structure, an open front end, apertures permitting the fine constituents to escape, and an excavating blade located at said open front end, the excavating further comprising rotating and locking said bucket into a substantially horizontal position, and moving the bucket into materials to be excavated;

(b) rotating the bucket above a location where materials are excavated, for the purpose of causing coarse constituents which hang out of said open front end of said bucket to drop back down onto the location of the excavated material;

(c) moving the bucket to an area for depositing fine constituents, and rotating the bucket continuously through at least one revolution in the same direction about an axis extending perpendicularly through said front side, for the purpose of producing shock free separating movements; and (d) after separating the fine constituents, tipping the bucket and rotating the bucket in said tipped position, for the purpose of collecting coarse constituents, which fall out said open front end, at a coarse constituent collection location.

* * * * *